US006316398B1

(12) United States Patent
Laux

(10) Patent No.: US 6,316,398 B1
(45) Date of Patent: Nov. 13, 2001

(54) GENERAL PURPOSE CLEANING COMPOSITION

(75) Inventor: Benjamin John Laux, Cincinnati, OH (US)

(73) Assignee: Diversey Lever, Inc., Plymouth, MI (US)

( * ) Notice: Subject to any disclaimer, the term of this patent is extended or adjusted under 35 U.S.C. 154(b) by 0 days.

(21) Appl. No.: 09/567,395

(22) Filed: May 9, 2000

(51) Int. Cl.[7] ..... C11D 1/38; C11D 3/04; C11D 3/43

(52) U.S. Cl. ..... 510/365; 510/245; 510/254; 510/504; 510/508

(58) Field of Search ..... 510/245, 254, 510/365, 504, 508; 134/42

(56) References Cited

U.S. PATENT DOCUMENTS 3,607,161 * 9/1971 Monick ..... 51/307
4,207,215 * 6/1980 Bolan ..... 252/542
4,724,090 * 2/1988 Suzuki et al. ..... 252/8.75
5,783,539 * 7/1998 Angervaare et al. ..... 510/223
5,922,663 * 7/1999 Gabriel et al. ..... 510/299
5,929,016 * 7/1999 Harrison ..... 510/384
5,939,374 * 8/1999 Richter et al. ..... 510/384
5,948,741 * 9/1999 Ochomogo et al. ..... 510/191
5,948,742 * 9/1999 Chang et al. ..... 510/191
6,121,219 * 9/2000 Herdt et al. ..... 510/218

* cited by examiner

*Primary Examiner*—Gregory Delcotto
(74) *Attorney, Agent, or Firm*—Edward A. Squillante, Jr.

(57) ABSTRACT

A general purpose cleaning composition for non-water soluble contaminants is described. The cleaning composition contains a cationic surfactant and a Group IIIa metal salt, and does not require a water treatment chemical to separate the contaminants from an emulsion made with the cleaning composition.

7 Claims, No Drawings

GENERAL PURPOSE CLEANING COMPOSITION

FIELD OF THE INVENTION

This invention is directed to a cleaning composition. More particularly, the invention is directed to a general purpose cleaning composition that effectively cleans oil, grease and other non-water soluble waste. The cleaning composition comprises a surfactant and a salt whereby waste is easily separated from the cleaning composition without the need of waste treatment chemicals.

BACKGROUND OF THE INVENTION

Conventional cleaning compositions, such as floor cleaning compositions, typically function by emulsifying contaminants, like oil and grease, when such cleaning compositions come in contact with the contaminants. Unfortunately, it is not uncommon for the resulting contaminant comprising emulsion to be discharged to a waste line in, for example, a factory or plant.

In an attempt to be more environmentally conscious, operators of many factories and plants have been treating contaminant comprising emulsions with expensive (and sometimes hazardous) waste treatment chemicals (e.g., deemulsifiers). These waste treatment chemicals, once added to the contaminant comprising emulsion, cause the contaminant to drop out of the emulsion, so that the oil or grease comprising contaminant may be removed (e.g., by skimming or filtering) before the cleaning composition is discharged to waste.

It is of increasing interest, however, to prepare a cleaning composition that does not have to be treated with waste treatment chemicals in order to separate oils and/or greases that have been emulsified in the cleaning composition. This invention, therefore, is directed to a superior cleaning composition that forms emulsions with oil, grease and other non-water soluble waste (contaminants) wherein the waste drops out of the emulsion in the absence of waste treatment chemicals.

DESCRIPTION OF BACKGROUND MATERIAL

Efforts have been disclosed for cleaning contaminants. In U.S. Pat. No. 5,529,696, a method for laundering oily items in wash solutions is described.

Other efforts have been disclosed for cleaning contaminants. In U.S. Pat. No. 4,826,618, a detergent composition with a free nonionic surfactant is described.

Still other attempts have been made to clean contaminants. In U.S. Pat. No. 4,262,465, a foam-controlled detergent with a pulverulent is described.

SUMMARY OF THE INVENTION

In a first aspect, this invention is directed to a cleaning composition capable of emulsifying a non-water soluble contaminant comprising:

(a) a first surfactant, the first surfactant being a cationic surfactant;

(b) a salt;

(c) with or without, a second surfactant, the second surfactant being a cationic, nonionic, anionic, amphoteric, or zwitterionic surfactant, or mixture thereof; and (d) with or without, a solvent, with the provisos that when the anionic surfactant is employed, the anionic surfactant does not react with the cationic surfactant to render the cationic surfactant ineffective, and the cleaning composition does not require a waste treatment chemical to separate the non-water soluble contaminant from the cleaning composition.

In a second aspect, this invention is directed to a method for using the cleaning composition of the first aspect of this invention.

DETAILED DESCRIPTION OF THE PREFERRED EMBODIMENTS

There generally is no limitation with respect to the type of cationic surfactant which may be employed in this invention other than that the surfactant is one which may be used in a cleaning composition. An illustrative list of the cationic surfactants which may be used in this invention include those comprising amino or quaternary ammonium hydrophilic moieties which are positively charged when dissolved in the general purpose cleaning composition of the present invention.

Among the quaternary ammonium-containing surfactants that may be used are quaternary ammonium salts including dialkyldimethylammonium chlorides and trialkylmethylammonium chlorides, wherein the alkyl groups have from about 12 to about 22 carbon atoms and are derived from long-chain fatty acids, such as hydrogenated tallow fatty acid. Examples of quaternary ammonium salts useful in the present invention include ditallowdimethyl ammonium chloride, ditallowdimethyl ammonium methyl sulfate, dihexadecyl dimethyl ammonium chloride, di(hydrogenated tallow) dimethyl ammonium chloride, dioctadecyl dimethyl ammonium chloride, dieicosyl dimethyl ammonium chloride, didocosyl dimethyl ammonium chloride, di(hydrogenated tallow) dimethyl ammonium acetate, dihexadecyl dimethyl ammonium chloride, dihexadecyl dimethyl ammonium acetate, ditallow dipropyl ammonium phosphate, ditallow dimethyl ammonium nitrate, di(coconutalkyl) dimethyl ammonium chloride, and stearyl dimethyl benzyl ammonium chloride.

Salts of primary, secondary and tertiary fatty amines may also be used as the cationic surfactant in the general purpose cleaning composition of the present invention. The alkyl groups of such amines preferably have from about 12 to about 22 carbon atoms, and may be substituted or unsubstituted. Secondary and tertiary amines are preferred, and tertiary amines are particularly preferred. Such amines, useful herein, include stearamido propyl dimethyl amine, diethyl amino ethyl stearamide, dimethyl stearamine, dimethyl soyamine, soyamine, myristyl amine, tridecyl amine, theyl stearylamine, N-tallowpropane diamine, ethoxylated (e.g., 5 moles E.O.) stearylamine, dihydoxy ethyl stearylamine, and arachidylbehenylamine. Suitable amine salts include the halogen, acetate, phosphate, nitrate, citrate, lactate and alkyl sulfate salts. Such salts include stearylamine hydrochloride, soyamine chloride, stearylamine formate, N-tallowpropane diamine dichloride and stearamidopropyl dimethylamine citrate.

These types of cationic surfactants are further described in U.S. Pat. Nos. 3,939,678, 3,959,461, 4,275,055 and 4,387,090, the disclosures of which are incorporated herein by reference.

The most preferred cationic surfactant that may be employed in this invention is, however, a substituted imidazoline of oleic acid, sold under the name Monazoline O and made commercially available from Mona Industries.

There typically is no limitation with respect to the amount of cationic surfactant which may be employed in the invention as long as the amount used results in a general purpose cleaning composition capable of effectively cleaning non-water soluble waste. Often, the amount of cationic surfactant makes up from about 0.2 to about 3.5%, and preferably, from about 0.3 to about 3.0%, and most preferably, from about 0.5 to about 1.5% by weight of the total weight of the cleaning composition, including all ranges subsumed therein.

There is no limitation with respect to the salt which may be used in this invention other than that the salt results in a general purpose cleaning composition capable of effectively cleaning non-water soluble waste. Preferably the metal (cation) portion of the salt which may be used in this invention is a Group IIIa metal (e.g., boron, aluminum or gallium) or a transition metal. In a most preferred embodiment, the metal portion is aluminum or iron.

As to the anion portion of the salt, any anion that is capable of making a salt with the cation may be used. Such an anion (including oxyanions) is often selected from the group consisting of a nitrite, nitrate, sulfite, sulfate, hypochlorite, chlorite, chlorate, hydroxide, chloride, bromide and sulfide. The preferred salts are aluminum or iron sulfate with aluminum sulfate being especially preferred.

There typically is no limitation with respect to the amount of salt used in the present invention as long as the amount used results in a general purpose cleaning composition capable of effectively cleaning non-water soluble waste. Often, the amount of salt is from about 0.5 to about 15.0%, and preferably, from about 1.0 to about 10.0%, and most preferably, from about 1.5 to about 5.0% of the total weight of the cleaning composition, including all ranges subsumed therein.

The nonionic surfactants which may be used in this invention are limited only to the extent that they may be used in the general purpose cleaning composition of this invention. Such nonionic surfactants may be broadly defined as compounds produced by the condensation of alkylene oxide groups with an organic hydrophobic compound which may be aliphatic or alkyl aromatic in nature.

Polyethylene oxide condensates of alkyl phenols are often preferred nonionic surfactants as are ethylene oxide comprising surfactants which comprise from about 10 to about 60 moles of ethylene oxide per mole of alkyl phenol. The alkyl substituent in such compounds may be derived, for example, from polymerized propylene, diisobutylene, octane, or nonane.

The nonionics derived from ethylene oxide which may be used include those containing from about 40% to about 80% polyoxyethylene by weight and having a molecular weight from about 5,000 to about 11,000. Such nonionics result from the reaction of ethylene oxide groups and a hydrophobic base consisting of the reaction product of ethylene diamine and excess propylene oxide, the base having a molecular weight from about 2,500 to about 3,000.

Still other nonionics which may be used include tertiary amine oxides, tertiary phosphine oxides, dialkyl sulfoxides, polyalkylene oxide modified dimethylpolysiloxanes, dimethicone copolyols and the like. A more detailed description of such nonionics may be found in U.S. Pat. No. 5,120,532, the disclosure of which is incorporated herein by reference.

The most preferred nonionics used in this invention include modified ethoxylates having an HLB of under about 15 Triton DF-1 2, made commercially available from Union Carbide. Another most preferred nonionic includes a $C_9$–$C_{11}$ linear alcohol ethoxylate such as Neodol 91-6 (made commercially available from Shell Chemical) having an HLB of under about 13.0. It is also noted herein that mixtures of the most preferred nonionics may be used.

There is no limitation with respect to the amount of nonionic employed, as long as the general purpose cleaning composition of this invention may be prepared. Typically, the amount of nonionic used is from about 1.0 to about 25.0%, and preferably, from about 2.0 to about 20.0%, and most preferably, from about 3.0 to about 15.0%, based on total weight of the general purpose cleaning composition, including all ranges subsumed therein. In a most desired embodiment, however, a mixture of nonionics is used with linear alcohol ethoxylates making up to about 50% by weight of the total weight of the nonionics.

The anionics which may be used in this invention include, for example, alkyl and alkyl ether sulfates, succinanates, olefinsulfonates and the like. The preferred anionic used is a modified ethoxylate sold under the name of Triton DF-20, made commercially available by Union Carbide. The amount of such anionics is limited such that the amount used does not render the cationic surfactant (used in the general purpose cleaning composition) ineffective.

As to the amphoteric surfactants which may be used in the general purpose cleaning compositions of the present invention, they include those which are broadly described as derivatives of aliphatic secondary and tertiary amines in which the aliphatic radical can be straight or branched chain and wherein one of the aliphatic substituents contains from about 8 to about 18 carbon atoms and one contains an anionic water solubilizing group, e.g., carboxy, sulfonate, sulfate, phosphate, or phosphonate. Examples of compounds falling within this definition are sodium 3-dodecylaminopropionate, sodium 3-dodecylaminopropane sulfonate, sodium lauryl sarcosinate, N-alkyltaurines such as the one prepared by reacting dodecylamine with sodium isethionate according to the teaching of U.S. Pat. No. 2,658,072, N-higher alkyl aspartic acids such as those produced according to the teaching of U.S. Pat. No. 2,438,091, and the products sold under the trade name "Miranol" and described in U.S. Pat. No. 2,528,378, wherein the disclosures of all are incorporated herein by reference.

The zwitterionic surfactants which may be used in this invention include those which can be broadly described as derivatives of aliphatic quaternary ammonium, phosphonium, and sulfonium compounds, in which the aliphatic radicals can be straight or branched chain, and wherein one of the aliphatic substituents contains from about 8 to about 18 carbon atoms and one contains an anionic group, e.g., carboxy, sulfonate, sulfate, phosphate, or phosphonate.

Examples of such zwitterionic surfactants include:

4-[N,N-di(2-hydroxyethyl)-N-octadecylammonio]-butaine-1-carboxylate; 5-[S-3-hydroxypropyl-S-hexadecylsulfonio]-3-hydroxypentane-1-sulfate; and 3-[P,P-diethyl-P-3,6,9-trioxatetradexocylphosphonio]-2-hydroxy-propane-1-phosphate.

Regarding the anionic surfactants, amphoteric surfactants and/or zwitterionic surfactants, when employed (alone or in combination) they typically make up from about 0.1% to about 25.0% of the total weight of the general purpose cleaning composition, including all ranges subsumed therein.

Many of the conventional additives commonly found in general purpose cleaning solutions may optionally be employed in this invention. These additives include caustics such as Group IA and IIA hydroxides with sodium hydroxide being preferred. The amount of caustic employed is typically greater than about 0.5% and less than about 15.0% by weight, based on the total weight of the general purpose cleaning composition and including all ranges subsumed therein.

Other additives which may be used in the general purpose cleaning compositions of this invention include solvents that are derivatives of high flash point alcohols (e.g., flash point greater than about 170). These solvents include alcohol glycol ethers like 3-methoxy-3-methyl-1-butanol. Such solvents typically make up more than about 0.1% and less than about 10.0% by weight of the total weight of the general purpose cleaning composition of this invention, including all ranges subsumed therein.

Still other additives which may be used include pH and temperature stabilizers. The pH stabilizers typically make up less than 10.0% by weight of the general purpose cleaning composition and are usually low molecular weight carboxylic acids like citric acid. The pH of the general purpose cleaning composition of this invention is typically between 5 and 8, and preferably, between 6.5 and 7.5.

The temperature stabilizers typically make up less than 5.0% by weight of the total weight of the general purpose cleaning composition. Such temperature stabilizers are usually aromatic salts like o-, m- or p-xylene sulfates with p-sodium xylene sulfate being especially preferred.

The balance of the cleaning composition of this invention is preferably water (second solvent) such as deionized water.

When using the general purpose cleaning composition of this invention, the cleaning composition is contacted with the contaminant (i.e., waste/spill) to form an emulsion. Typically, the general purpose cleaning composition is diluted with about 90 to about 99.5% by weight water, and about 0.5 to about 3.0 parts of the diluted general purpose cleaning composition is used for about every 1.0 part of contaminant. However, it is most preferred that about 1.0 part of diluted general purpose cleaning composition is used for about every 1.0 part of contaminant.

Subsequent to contacting the general purpose cleaning composition with the contaminant, an emulsion is formed upon mixing. The mixing is achieved by an art recognized technique, including with a scrub brush or mop. The emulsion may be classified as a temporary emulsion since the emulsion's water soluble phase and non-water soluble waste (contaminant) separate into two phases (usually within about 5 to 10 minutes) without requiring waste treatment chemicals (deemulsifiers). This allows for easy discharge of the waste as well as for the recycling of the superior general purpose cleaning composition of this invention. It is noted that the two phases may easily be separated by any art recognized technique, including skimming and filtering.

The following examples are provided for illustrative purposes and are not intended as a restriction on the scope of the invention. Thus, it is obvious that various changes may be made to the specific embodiments of this invention without departing from its spirit. Accordingly, the invention is not limited to the precise embodiments shown and described, but only as indicated in the following claims.

EXAMPLE 1

| A mixing vessel was charged with the following: | Percent by Weight |
|---|---|
| Aluminum sulfate | 3.0 |
| NaOH (50%) | 9.0 |
| Manazoline O | 1.0 |
| Triton DF-20 | 4.0 |
| Triton DF-12 | 1.0 |
| 3-methoxy-3-methyl-1-butanol | 5.0 |

-continued

| A mixing vessel was charged with the following: | Percent by Weight |
|---|---|
| Neodol 91-6 | 5.0 |
| Sodium xylene sulfate | 3.0 |
| Citric acid | 6.0 |
| Deionized water | 63.0 |

The contents were stirred at room temperature until a homogeneous general purpose cleaning composition was obtained.

EXAMPLE 2

The general purpose cleaning composition made in Example 1 was diluted with water to produce a diluted 4.0% by weight general purpose cleaning composition. The diluted general purpose cleaning composition was applied (with a mop) to an oil spill (lubricoolant as made commercially available by DiverseyLever). The amount of general purpose cleaning composition applied was about equal to the volume of the oil spill. Upon mixing the cleaning composition and oil spill with the mop, an emulsion was made. The oil phase and water phase of the emulsion separated in approximately five (5) minutes (without a deemulsifier) and the two phases were easily separated with a feed split tank.

What is claimed is:

1. A liquid cleaning composition for emulsifying a non-water soluble contaminant, the cleaning composition comprising:

(a) from about 0.2% to about 3.5% by weight of a first surfactant, the first surfactant being a cationic surfactant;

(b) from about 0.5% to about 15% by weight of a salt, selected from the group consisting of aluminum sulfate, iron sulfate, and mixtures thereof; and from about 0.1% to 10% by weight of a solvent, the cleaning composition being with or without a second surfactant, the second surfactant being a cationic, nonionic, anionic, amphoteric or zwitterionic surfactant.

2. The cleaning composition according to claim 1 wherein the first surfactant is an imidazoline of oleic acid.

3. The cleaning composition according to claim 1 wherein the cleaning composition further comprises water.

4. The cleaning composition according to claim 1 wherein the solvent is 3-methoxy-3-methyl-1-butanol.

5. The cleaning composition according to claim 1 wherein the cleaning composition further comprises from about 1.0 to about 25.0% nonionic surfactant.

6. The cleaning composition according to claim 5 wherein the cleaning composition is further diluted with about 90 to about 99.5% by water.

7. The cleaning composition according to claim 5 wherein the nonionic surfactant is a mixture of up to about 50% linear alcohol ethoxylate and a second ethoxylate having an HLB of less than about 15.

* * * * *